US009377264B2

(12) United States Patent
Ely

(10) Patent No.: US 9,377,264 B2
(45) Date of Patent: Jun. 28, 2016

(54) VERTICAL HANGING DEVICE FOR AR-15/M4 STYLE RIFLES

(71) Applicant: Chad Michael Ely, Three Rivers, MI (US)

(72) Inventor: Chad Michael Ely, Three Rivers, MI (US)

( * ) Notice: Subject to any disclaimer, the term of this patent is extended or adjusted under 35 U.S.C. 154(b) by 0 days.

(21) Appl. No.: 14/797,792

(22) Filed: Jul. 13, 2015

(65) Prior Publication Data

US 2016/0025440 A1 Jan. 28, 2016

Related U.S. Application Data

(60) Provisional application No. 62/024,529, filed on Jul. 15, 2014.

(51) Int. Cl.
*F41A 23/18* (2006.01)

(52) U.S. Cl.
CPC ..... *F41A 23/18* (2013.01)

(58) Field of Classification Search
CPC ..... A47B 81/005; F41A 23/16; F41A 23/18
USPC ..... 211/64; 42/94
See application file for complete search history.

(56) References Cited

U.S. PATENT DOCUMENTS 5,263,592 A * 11/1993 Dingee, Jr. ..... A47B 81/005 211/4
5,797,500 A * 8/1998 Lacoste ..... A47B 81/005 211/64
D551,005 S * 9/2007 Walterscheid ..... D6/552

* cited by examiner

*Primary Examiner* — Reginald Tillman, Jr.

(57) ABSTRACT

Relating to the field of rifle storage, the invention allows an AR or other similarly styled rifle to be hung and stored vertically, thus eliminating the need for large, expensive and obtrusive equipment. Constructed of ¼" diameter steel rod bent in a unique fashion that touches the rifle in only two places—on the forward portion of the magazine well and on the upper portion of the buffer tube/buttstock area. The invention provides a way to reliably hang a rifle perpendicular to the floor, using its top-heavy center of gravity in a way that uses the rifle's weight to secure the rifle without any moving parts. This allows the user to hang a rifle from any horizontal fixture that can support the weight of the rifle.

2 Claims, 4 Drawing Sheets

VERTICAL HANGING DEVICE FOR AR-15/M4 STYLE RIFLES

FIELD OF THE INVENTION

This invention relates to the method and system of rifle storage. More specifically, the invention provides a quick, simple, balanced, and secure method of storing an AR-15/M4 style rifle via method of hanging vertically on any common horizontal bar. Specifically, the invention relates to a novel technique for storage of the AR-15/M4 style rifle requiring very little room (ex: closet). The invention is also further applicable to any size rifle that has a magazine well and many variations of butt stock lengths.

BACKGROUND OF THE INVENTION

There are many known methods of storing rifles. Some methods require racks inside of large cabinets, multiple hooks, or cases. All of these methods can be expensive and require the purchase of large, obtrusive equipment to securely hold a rifle due to the top-heavy nature of the AR-15/M4 platform. These methods require a large space which many rifle owners do not have. Many of these methods also do not allow the rifle owner to quickly acquire and use the weapon in his own home if needed for self-defense.

Most AR-15/M4 platform rifles include a rail system where users may mount various types of equipment to the top of the rifle. This therefore, creates a very top-heavy center of gravity on the rifle and makes it almost impossible for the rifle to be hung vertically at a 90° angle perpendicular to the floor by any current means without interfering with the added equipment and tipping forward. The present invention provides a way to reliably hang a rifle off and perpendicular to the floor, using its top-heavy center of gravity in a way that uses the weight to secure the rifle without any moving parts.

The present invention seeks to allow for an effective and easy method of storage anywhere a secure horizontal bar or protrusion is located (ex: closet or safe) in a simple, stable, balanced, and vertical manner perpendicular to the floor without touching the floor and without any moving parts. The present invention will reduce space needed as well as reduce the time it takes to quickly acquire the rifle.

SUMMARY OF THE INVENTION

The method and the system of this invention center around the innovative concept of using a single piece of metal rod, bent in a manner that fits snugly around 2 universal elements of the AR-15/M4 platform while taking into consideration the forward lean of the rifle caused by its center of gravity when held vertically without any type of floor-based method of anchoring and providing a quick and reliable way to grab the rifle by the grip to dislocate it from the hanging rack. The present invention uses only two universally-sized elements on the rifle to hold the rifle in place. These are the outside of the universally-sized mag well located under the weapon and the outer area behind the rear plate of the upper receiver located on the top of the weapon. When in place, the present invention is a means of retaining an AR-15/M4 style weapon in a manner that both secures and balances the weapon in a vertical manner, at a 90° angle, perpendicular to the floor by using minimum points of contact as well as gravity to keep the weapon in place.

BRIEF DESCRIPTION OF THE DRAWINGS

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention is capable of contemplating. Accordingly.

The broken line showing a portion of the gun mounted in the gun hanger device and the horizontal beam or rod from which the rifle hanger device is suspended is for illustrative purposes and forms no part of the claim.

DETAILED DESCRIPTION OF THE INVENTION

Figure 1:
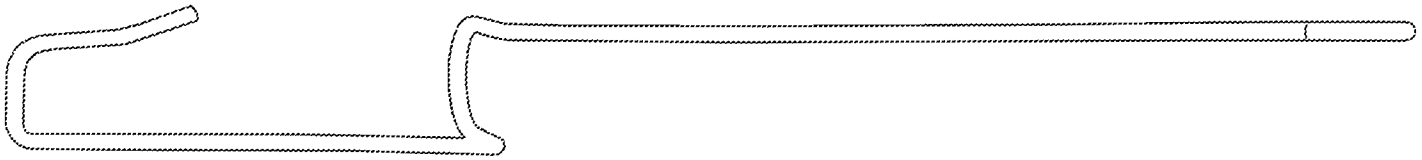
FIG. 1 is an isometric view of a rifle hanger showing my new design.
Figure 2:
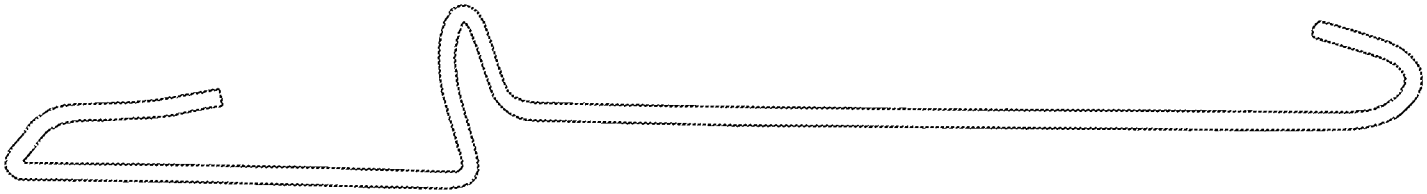
FIG. 2 is a three-quarters side view diagram of the rifle hanger.
Figure 3:
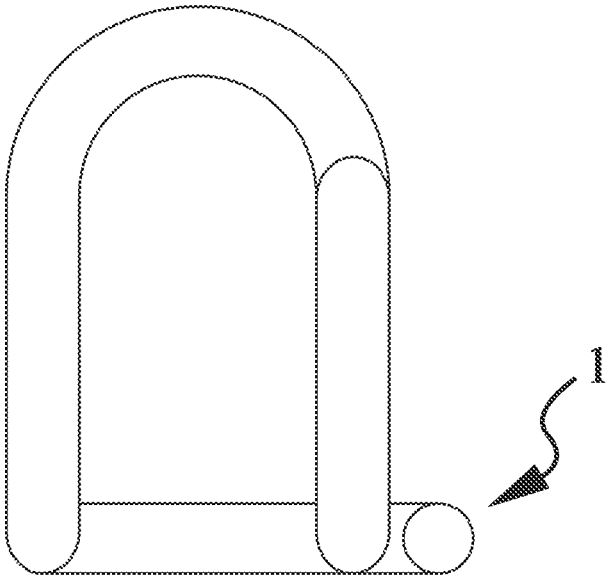
FIG. 3 is a simplified top side view of the rifle hanger.
Figure 4:
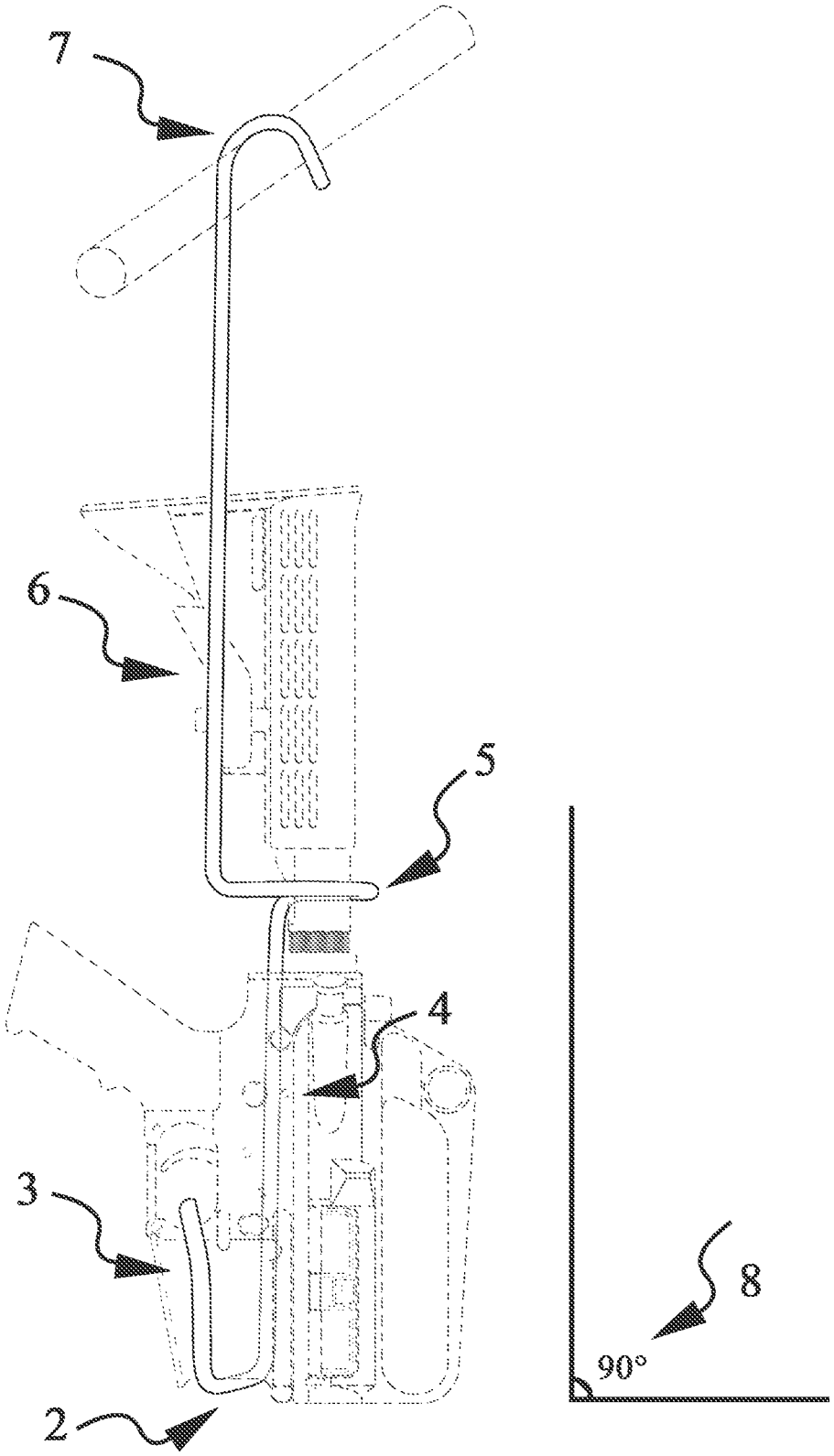
FIG. 4 is an isometric view of the rifle hanger showing it in use.

Referring to FIG. 4, without any moving parts, the rifle hanger provides a secure method of suspension and attachment by wrapping around the magazine well 2 with a slight angle at the end 3, providing a larger opening so that the magazine well may not get caught when sliding in. The rifle hanger then travels up the side of the rifle 4 in a manner that does not touch any key components of the rifle. From there, the rifle hanger wraps around the top of the butt stock assembly 5, accomplishing two things to properly secure the rifle. First, it prevents the rifle from falling forward due to its high and forward center of gravity. Second, it prevents any side-to-side motion, providing a universal fit and method of securing the majority of AR-15/M4 platform rifles on the market today. After wrapping around the butt stock 5, the rifle hanger travels up the side of the rifle again 6 until it terminates with a hook 7. The hook 7 is the method by which the rifle may be hung on any type of horizontal rod that will support the weight of the rifle. The rifle hanger uses the above method to hold the rifle at a 90° angle perpendicular to the floor 8.

Due to the simplicity of use and small size of the rifle hanger, the rifle can quickly be hung for storage in very tight spaces. Because the rifle hanger does not interfere with any working part of the rifle, the rifle may be hung, loaded, and even operated while the rifle hanger is still attached to the rifle itself.

Due to the universal specifications of the rifle hanger, all rifles based on the AR-15/M4 platform will fit including any training or toy rifles.

The present invention is manufactured by using a hydraulic tabletop bender to exact each bend according to the design shown in FIGS. 1 through 4.

While the present invention has been described in terms of particular embodiments and applications, in both summarized and detailed forms, it is not intended that these descriptions in any way limit its scope to any such embodiments and applications, and it will be understood that variations in the described embodiment of the method and system illustrated herein and of their operation can be made without departing from the spirit of this invention.

What is claimed is:

1. A rifle hanger for hanging a rifle, the hanger comprising:

an elongated bar having opposing first and second end portions and a middle portion;

the first end portion includes a first bend including a first receiving slot extending in the longitudinal direction of the rifle hanger, the first receiving slot being configured to wrap around the magazine well of the rifle;

the middle portion includes a second bend having a second receiving slot extending in the lateral direction of the hanger, the second receiving slot being configured to wrap around the buttstock assembly of the rifle to prevent the rifle from falling forward or side-to-side;

the second end portion configured to extend past the end of the buttstock assembly and having a hook with a third receiving slot extending in the longitudinal direction of the hanger, the hook being configured to hang on a horizontal rod.

2. The rifle hanger of claim 1 wherein the hanger is made from a single, unitary piece of material.

* * * * *